US010888893B2

(12) United States Patent
Stensvad et al.

(10) Patent No.: US 10,888,893 B2
(45) Date of Patent: Jan. 12, 2021

(54) SLOT DIE WITH ACTIVELY CONTROLLED COATING WIDTH

(71) Applicant: 3M INNOVATIVE PROPERTIES COMPANY, St. Paul, MN (US)

(72) Inventors: Karl K. Stensvad, Inver Grove Heights, MN (US); Jonathan J. O'Hare, Oakdale, MN (US); Daniel H. Carlson, Arden Hills, MN (US); Glen A. Jerry, Blaine, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

(21) Appl. No.: 16/071,708

(22) PCT Filed: Feb. 6, 2017

(86) PCT No.: PCT/US2017/016661
§ 371 (c)(1),
(2) Date: Jul. 20, 2018

(87) PCT Pub. No.: WO2017/139219
PCT Pub. Date: Aug. 17, 2017

(65) Prior Publication Data

US 2019/0030560 A1 Jan. 31, 2019

Related U.S. Application Data

(60) Provisional application No. 62/294,387, filed on Feb. 12, 2016.

(51) Int. Cl.
*B05C 5/02* (2006.01)
*B05C 11/10* (2006.01)

(52) U.S. Cl.
CPC ..... *B05C 5/0266* (2013.01); *B05C 11/1002* (2013.01)

(58) Field of Classification Search
None
See application file for complete search history.

(56) References Cited

U.S. PATENT DOCUMENTS 5,435,847 A 7/1995 Shibata
5,620,517 A 4/1997 Saitoh
(Continued)

FOREIGN PATENT DOCUMENTS

EP 2886200 6/2015
JP 2001-170542 6/2001
(Continued)

OTHER PUBLICATIONS

International Search Report for PCT International Application No. PCT/US2017/016661, dated Jun. 1, 2017, 3 pages.

*Primary Examiner* — Jethro M. Pence
(74) *Attorney, Agent, or Firm* — Yufeng Dong

(57) ABSTRACT

Coating apparatuses and methods are provided for dispensing coatings with various shapes. The coating apparatus includes a coating die body including a cavity and an opening on a dispensing side thereof. One or more movable components are disposed on the dispensing side of the die body to define at least a portion of a dispensing slot adjacent the opening of the cavity. The one or more movable components are movable with respect to the opening to allow a width of the dispensing slot along a cross direction to be dynamically adjustable.

18 Claims, 7 Drawing Sheets

(56) References Cited

U.S. PATENT DOCUMENTS

| | | | | |
|---|---|---|---|---|
| 5,862,993 | A | 1/1999 | Bagung | |
| 6,565,660 | B1 | 5/2003 | Wagner | |
| 9,061,312 | B2 | 6/2015 | Kitani | |
| 2006/0257574 | A1* | 11/2006 | Pekurovksy | B05C 5/0254 427/355 |
| 2008/0022930 | A1 | 1/2008 | Pekurovsky | |
| 2011/0041756 | A1* | 2/2011 | Isoda | B05C 5/0225 118/300 |
| 2011/0287171 | A1* | 11/2011 | Seo | B05C 5/0262 427/8 |
| 2014/0242283 | A1 | 8/2014 | Joos | |

FOREIGN PATENT DOCUMENTS

| | | |
|---|---|---|
| JP | 2002-066420 | 3/2002 |
| JP | 3301727 | 7/2002 |
| WO | WO 2014-088936 | 6/2014 |
| WO | WO 2014-088939 | 6/2014 |

* cited by examiner

SLOT DIE WITH ACTIVELY CONTROLLED COATING WIDTH

CROSS REFERENCE TO RELATED APPLICATIONS

This application is a national stage filing under 35 U.S.C. 371 of PCT/US2017/016661, filed Feb. 6, 2017, which claims the benefit of U.S. Application No. 62/294,387, filed Feb. 12, 2016, the disclosure of which is incorporated by reference in its/their entirety herein.

TECHNICAL FIELD

The present disclosure relates to slot die coating systems and methods with actively controlled coating width for direct coating various shapes.

BACKGROUND

Available slot die coating systems rely on highly accurate and stable die geometry and fluid delivery to produce stable coatings. Starts and stops of the coating as well as width changes may lead to non-uniform coatings. To change the width of a dispensing slot, a stationary shim inside the coating die needs to be changed, or one or more movable deckles inside a manifold or cavity of the coating die are required. Various die coating techniques are described in JP Patent Application Publication Nos. 11-333906, 2013-189011, 2002-066420, and 2002-066420.

SUMMARY

Briefly, in one aspect, the present disclosure describes an apparatus that includes a die body including a cavity having an opening on a dispensing side thereof. One or more movable components are disposed on the dispensing side of the die body to define at least a portion of a dispensing slot adjacent the opening of the cavity. The one or more movable components are movable with respect to the opening to allow a width of the dispensing slot along a cross direction to be dynamically adjustable. In some embodiments, the one or more movable components may include one or more die lips that define the dispensing slot.

In another aspect, the present disclosure describes a method of dispensing a liquid using an apparatus described herein. The apparatus includes a die body including a cavity having an opening on a dispensing side thereof. One or more movable components are disposed on the dispensing side of the die body to define at least a portion of a dispensing slot adjacent the opening of the cavity. The one or more movable components are movable with respect to the opening to allow a width of the dispensing slot along a cross direction to be dynamically adjustable. The method further includes supplying the liquid at a flow rate into a cavity of a die body, and moving at least one of the movable components along the cross direction to dynamically change the width of the dispensing slot thereof. In some embodiments, the method may further include adjusting the flow rate while dynamically changing the width of the dispensing slot and dispensing the liquid onto a substrate to coat fluid (e.g., a liquid patch with definite or indefinite length).

Various unexpected results and advantages are obtained in exemplary embodiments of the disclosure. One such advantage of exemplary embodiments of the present disclosure is that the width of the dispensing slot can be dynamically adjusted during dispensing liquid such that liquid coatings (e.g., discrete patches or continuous stripes) with various shapes can be directly coated on a substrate with minimum converting waste. In some cases, the dynamical width adjustment can be achieved by rapidly (e.g., at a frequency no less than 0.1 Hz) moving a movable structure or component that defines the dispensing slot back and forth along the cross direction.

Various aspects and advantages of exemplary embodiments of the disclosure have been summarized. The above Summary is not intended to describe each illustrated embodiment or every implementation of the present certain exemplary embodiments of the present disclosure. The Drawings and the Detailed Description that follow more particularly exemplify certain preferred embodiments using the principles disclosed herein.

BRIEF DESCRIPTION OF THE DRAWINGS

The disclosure may be more completely understood in consideration of the following detailed description of various embodiments of the disclosure in connection with the accompanying figures, in which.

Figure 1:
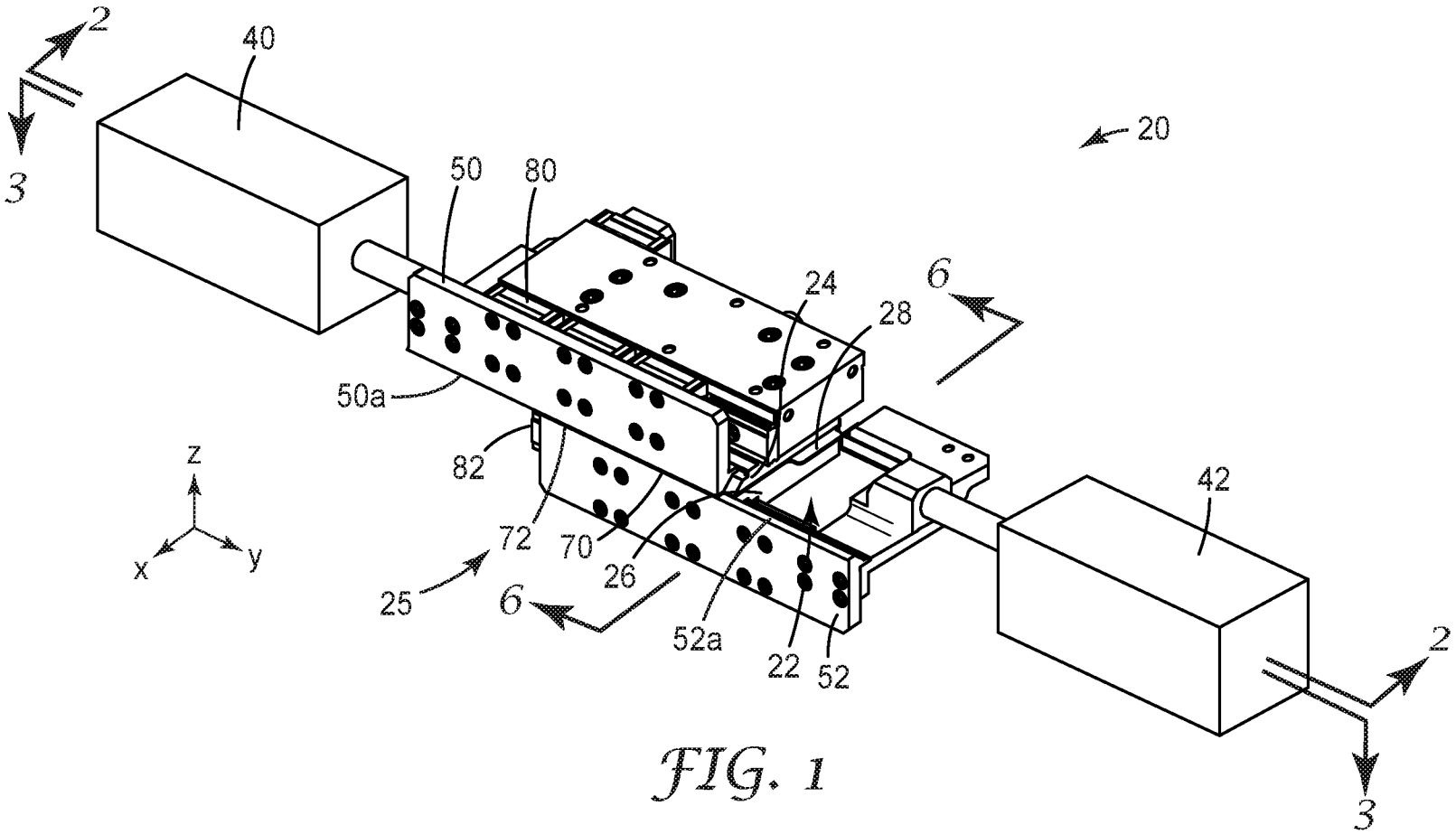
FIG. 1 is a perspective view of a coating apparatus according to one embodiment of the present disclosure.

In the drawings, like reference numerals indicate like elements. While the above-identified drawing, which may not be drawn to scale, sets forth various embodiments of the present disclosure, other embodiments are also contemplated, as noted in the Detailed Description. In all cases, this disclosure describes the presently disclosed disclosure by way of representation of exemplary embodiments and not by express limitations. It should be understood that numerous other modifications and embodiments can be devised by those skilled in the art, which fall within the scope and spirit of this disclosure.

DETAILED DESCRIPTION

For the following Glossary of defined terms, these definitions shall be applied for the entire application, unless a different definition is provided in the claims or elsewhere in the specification.

Glossary

Certain terms are used throughout the description and the claims that, while for the most part are well known, may require some explanation. It should be understood that:

The term "slot die coating" refers to a process of applying a variety of coating materials (e.g., liquid) from an internal manifold or cavity of a coating die through a dispensing slot thereof. In some cases, the coating materials can be dispensed onto a substrate at a controlled rate while the substrate is moved relative to the coating die.

The term "dynamically" means that the adjustment of the width of a dispensing slot occurs at a high rate of speed, for example, at a rate fast enough to change the wide of the dispensing slot in real time, resulting in an article that varies in width as part of its intended function.

The term "adjoining" with reference to a particular layer means joined with or attached to another layer, in a position wherein the two layers are either next to (i.e., adjacent to) and directly contacting each other, or contiguous with each other but not in direct contact (i.e., there are one or more additional layers intervening between the layers).

By using terms of orientation such as "atop", "on", "over," "covering", "uppermost", "underlying", "bottom", "upper" and the like for the location of various elements in the disclosed apparatuses, we refer to the relative position of an element with respect to a horizontally-disposed, upwardly-facing substrate. However, unless otherwise indicated, it is not intended that the substrate or articles should have any particular orientation in space during or after manufacture.

By using the term "overcoated" to describe the position of a layer with respect to a substrate or other element of an article of the present disclosure, we refer to the layer as being atop the substrate or other element, but not necessarily contiguous to either the substrate or the other element.

The terms "about" or "approximately" with reference to a numerical value or a shape means+/−five percent of the numerical value or property or characteristic, but expressly includes the exact numerical value. For example, a viscosity of "about" 1 Pa-sec refers to a viscosity from 0.95 to 1.05 Pa-sec, but also expressly includes a viscosity of exactly 1 Pa-sec. Similarly, a perimeter that is "substantially square" is intended to describe a geometric shape having four lateral edges in which each lateral edge has a length which is from 95% to 105% of the length of any other lateral edge, but which also includes a geometric shape in which each lateral edge has exactly the same length.

The term "substantially" with reference to a property or characteristic means that the property or characteristic is exhibited to a greater extent than the opposite of that property or characteristic is exhibited. For example, a substrate that is "substantially" transparent refers to a substrate that transmits more radiation (e.g. visible light) than it fails to transmit (e.g. absorbs and reflects). Thus, a substrate that transmits more than 50% of the visible light incident upon its surface is substantially transparent, but a substrate that transmits 50% or less of the visible light incident upon its surface is not substantially transparent.

As used in this specification and the appended embodiments, the singular forms "a", "an", and "the" include plural referents unless the content clearly dictates otherwise. Thus, for example, reference to fine fibers containing "a compound" includes a mixture of two or more compounds. As used in this specification and the appended embodiments, the term "or" is generally employed in its sense including "and/or" unless the content clearly dictates otherwise.

As used in this specification, the recitation of numerical ranges by endpoints includes all numbers subsumed within that range (e.g. 1 to 5 includes 1, 1.5, 2, 2.75, 3, 3.8, 4, and 5).

Unless otherwise indicated, all numbers expressing quantities or ingredients, measurement of properties and so forth used in the specification and embodiments are to be understood as being modified in all instances by the term "about." Accordingly, unless indicated to the contrary, the numerical parameters set forth in the foregoing specification and attached listing of embodiments can vary depending upon the desired properties sought to be obtained by those skilled in the art utilizing the teachings of the present disclosure. At the very least, and not as an attempt to limit the application of the doctrine of equivalents to the scope of the claimed embodiments, each numerical parameter should at least be construed in light of the number of reported significant digits and by applying ordinary rounding techniques.

Exemplary embodiments of the present disclosure may take on various modifications and alterations without departing from the spirit and scope of the present disclosure. Accordingly, it is to be understood that the embodiments of the present disclosure are not to be limited to the following described exemplary embodiments, but is to be controlled by the limitations set forth in the claims and any equivalents thereof.

Figure 2:
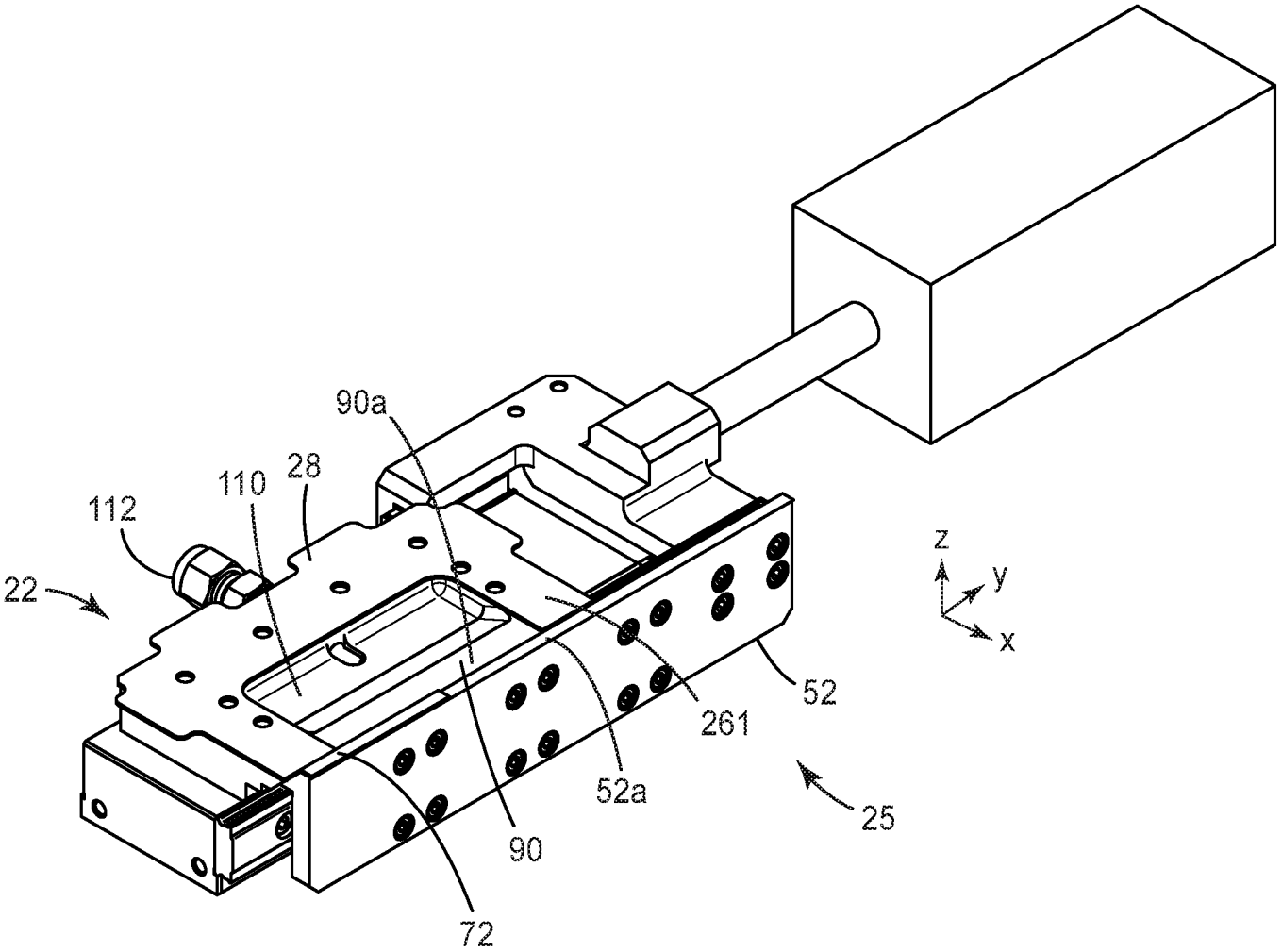
FIG. 2 is a perspective partial view of the coating apparatus of FIG. 1.
Figure 3:
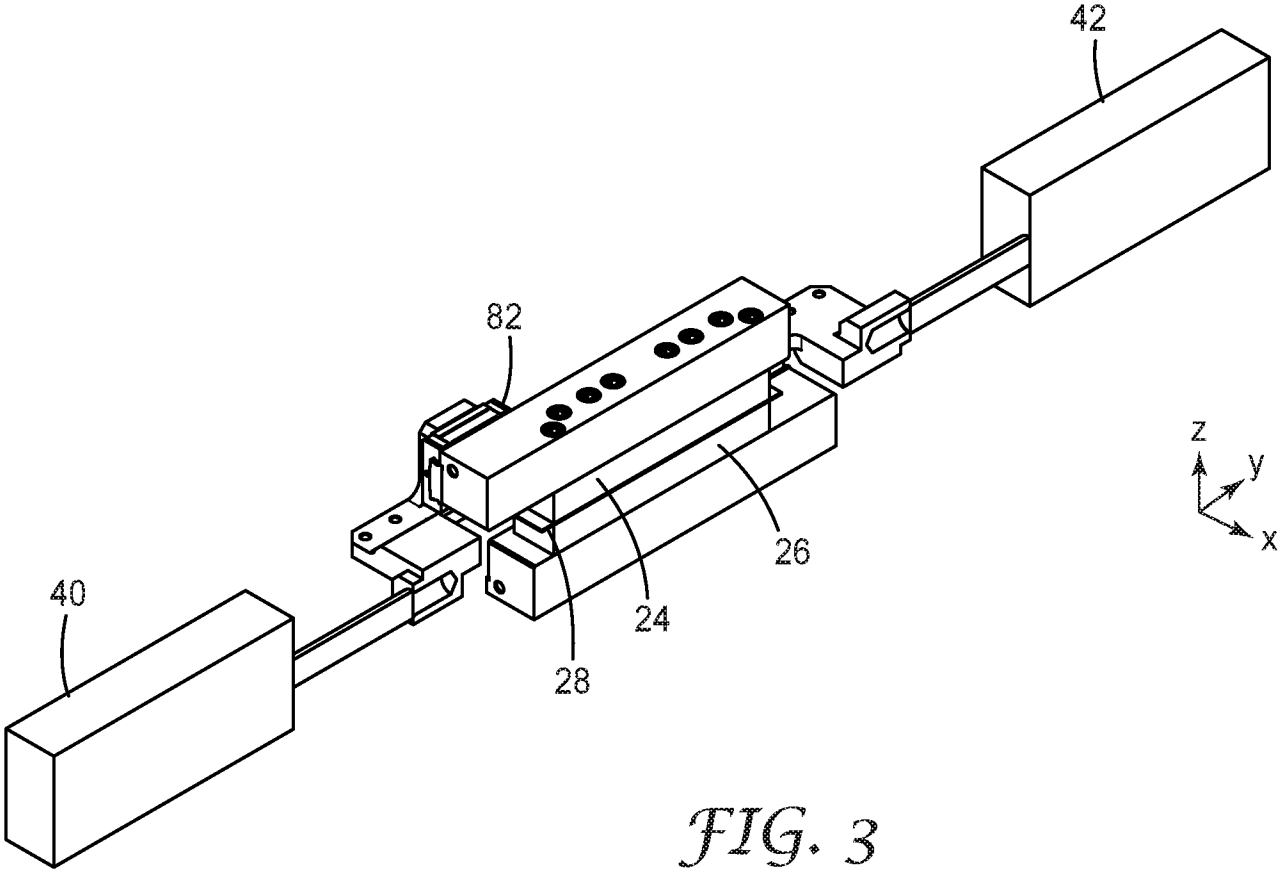
FIG. 3 is a cross-section side view taken along section lines 3-3 in FIG. 1.

Referring now to FIGS. 1-3, FIG. 1 is a perspective view of a coating apparatus 20 according to one embodiment of the present disclosure shown in an x-y-z Cartesian coordinate system. FIG. 2 is a perspective partial view of the coating apparatus 20 with some components above section lines 2-2 in FIG. 1 removed. FIG. 3 is a cross section view that taken along section lines 3-3 in FIG. 1. The coating apparatus 20 includes a coating die body 22 having a first die portion 24 and a second die portion 26. The die portions 24 and 26 have respective faces (e.g., face 261 of the second die portion 26 shown in FIG. 2) connected to form the coating die body 22. A stationary shim 28 is conveniently present to seal the connected faces of the first die portion 24 and the second die portion 26. In some embodiments, the stationary shim 28 may be built into the coating die body 22 as a one-piece configuration. In some embodiments, the coating die body 22 itself may be a unit piece with an internal cavity and an external opening.

In the view of FIG. 2, an internal cavity 110 of the die body 22 is conveniently present, a feature seen in many coating die arrangements. The stationary shim 28 is positioned around at least a portion of the periphery of the cavity 110 to seal the cavity 110 except for an external opening 90 located at a dispensing side 25 of the coating die body 22. The cavity 110 narrows along the x-axis toward the dispensing side 25 to form the external opening 90. During operation, the cavity 110 can be filled with materials (e.g., fluid precursors such as adhesives, functional coating materials, paints, etc.) to be coated via a manifold connection 112, and the coating materials can be dispensed through the external opening 90 and applied onto a moving substrate. In some embodiments, the cavity 110 can have a substantially fixed volume. That is, the volume of the cavity 110 is not changed during dispensing of coating materials. For example, no movable deckles are disposed inside the cavity 110 to adjust the volume of the cavity during the dispensing of materials. The external opening 90 has a width along the y-axis (i.e., a cross direction), and a thickness along the z-axis. In some embodiments, the width and thickness of the external opening 90 can also be fixed.

Referring again to FIG. 1, the coating apparatus 20 further includes first and second die lips 50 and 52 which are respectively attached to the first and second die portions 24 and 26 on the dispensing side 25 of the coating die body 22. Mechanisms 80 and 82 can attach the die lips 50 and 52 to the coating die body 22 and allow the die lips 50 and 52 to respectively slide on the die body 22 along a single axis (e.g., the y-axis). The mechanisms 80 and 82 each can be or include, for example, linear rails, profiled rails, round rails, dovetail, or other sides that provide high stiffness with a signal axis of motion. It is to be understood that any suitable mounting mechanisms can be used to slidably mount the die lips 50 and 52 onto the dispensing side 25 of the coating die body 22.

Figure 4:
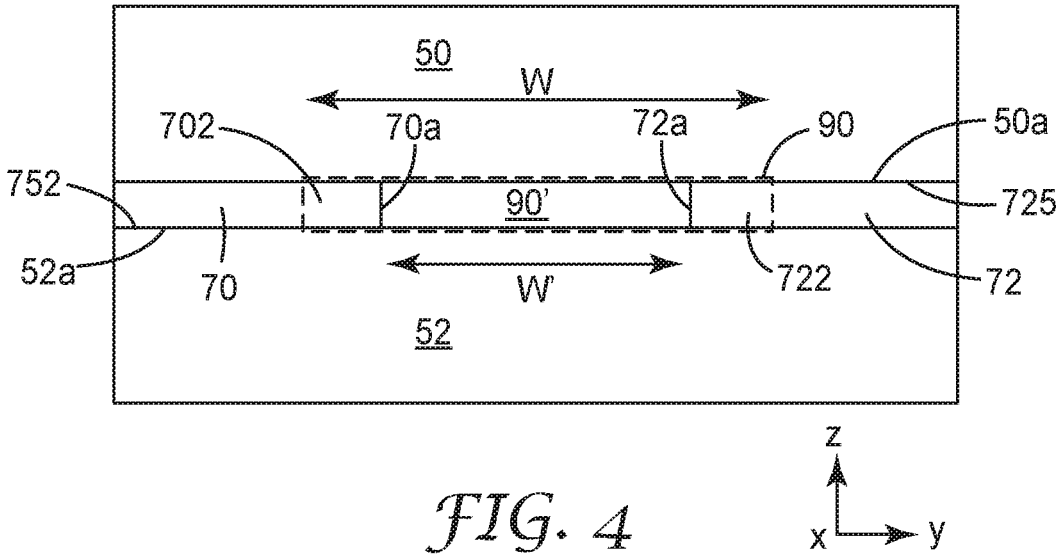
FIG. 4 is a schematic view of a dispensing slot of the coating apparatus of FIG. 1.

The die lips 50 and 52 are positioned to have the respective abutting surfaces 50*a* and 52*a* facing each other and approximately aligned with the external opening 90 of the coating die body 22, which is also shown in FIG. 4. FIG. 2 illustrates one abutting surface 52*a* of the die lip 52 that is approximately aligned with a bottom surface 90*a* of the external opening 90. Similarly, the abutting surface 50*a* of the movable die lip 50 can be approximately aligned with an upper surface (not shown) of the external opening 90. In some embodiments, the die lips 50 and 52 are aligned with the respective abutting surfaces 50*a* and 52*a* being substantially parallel to each other.

The first and second die lips 50 and 52 are respectively movable back and forth along the y-axis. In the depicted embodiment of FIG. 1, the first and second die lips 50 and 52 are connected to the respective first and second linear actuators 40 and 42 via suitable coupling attachments. Suitable linear actuators may include, for example, linear motors, hydraulic, voice-coils or piezoelectric actuators, etc. In some embodiments, the first and second linear actuators 40 and 42 are capable of continuously moving at least one of the first and second movable die lips 50 and 52 back and forth along the y-axis (i.e., a cross direction). It is to be understood that the any suitable mechanisms other than the linear actuators 40 and 42 can be used to slidably move the die lips 50 and 52 on the dispensing side 25 of the coating die body 22 back and forth along the y-axis. In some embodiments, one or more position sensing mechanisms may be provided, which may be integrated into the actuators or attached to the moving die lips. Depending on the specific actuator types, one or more linear coupling mechanisms may be provided to ensure that the actuators only generate motion along the y-axis (i.e., cross direction).

The dynamical movement of die lips along the cross direction can be conducted at a frequency in a range, for example, from about 0.05 Hz to about 1000 Hz, or from about 0.1 Hz to about 500 Hz, with a maximum distance in a range, for example, from about 1 mm to about 100 cm. It is to be understood that the maximum distance may depend on the size of the substrate and the coating stripes, patches or patterns to be formed on the substrate.

The first and second movable die lips 50 and 52 further include first and second shims 70 and 72 that are attached to the respective abutting surfaces 50*a* and 52*a* thereof. The shims 70 and 72 are attached to and movable along with the respective die lips 50 and 52 back and forth along the y-axis. In some embodiments, the shims 70 and 72 can be separate pieces that are attached to the respective die lips 50 and 52. In some embodiments, the shims 70 and 72 can be made of a low friction polymer such as, for example, polytetrafluoroethylene (PTFE), a metal with low friction/high hardness coatings, etc. In some embodiments, the shims 70 and 72 can be embossments formed on the respective abutting surfaces 50*a* and 52*a*.

The shims 70 and 72 each elongate along the y axis and are positioned adjacent the external opening 90 of the coating die body 22. The shims 70 and 72 have suitable thickness and length and are positioned to at least partially block the external opening 90 of the cavity 110. In some embodiments, the shims 70 and 72 each may have a length along the y-axis that is at least about ½ of the width of the external opening 90.

When the first and second movable die lips 50 and 52 are mounted onto the dispensing side 25 of the coating die body 22, the shims 70 and 72 of the die lips 50 and 52 abut against the opposite abutting surfaces 52*a* and 50*a*, respectively, and define a dispensing slot 90' that is adjacent to and in fluid communication with the external opening 90 of the coating die body 22. As shown in FIG. 4, the shim 70 of the first movable die lip 50 contacts to the abutting surface 52*a* of the second movable die lip 52 to form a first slidable sealing contact 752, and the shim 72 of the second movable die lip 52 contacts to the abutting surface 50*a* of the first movable die lip to form a second slidable sealing contact 725.

Figure 5:
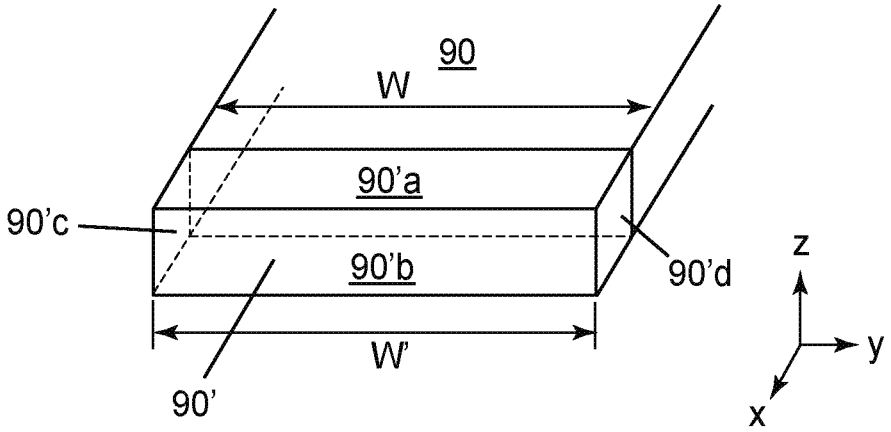
FIG. 5 is a schematic view of a dispensing slot of the coating apparatus of FIG. 1.

FIGS. 4 and 5 further illustrate the formation of the dispensing slot 90' and its relative position with respect to the external opening 90 of the coating die body 22. The dispensing slot 90' has a first major surface 90'*a* that is formed by a portion of the abutting surface 50*a* of the first movable die lip 50, a second major surface 90'*b* that is formed by a portion of the abutting surface 52*a* of the second movable die lip 52, a first side surface 90'*c* that is formed by an end 70*a* of the first shim 70 attached to the first movable die lip 50, and a second side surface 90'*d* that is formed by an end 72*a* of the second shim 72 attached to the second movable die lip 50. The first and second major surfaces 90'*a-b*, and the first and second side surfaces 90'*c-d* are the forming surfaces that define the dispensing slot 90'.

When the first and second die lips 50 and 52 move back and forth along the y-axis, the shims 70 and 72 can move along with the respective die lips 50 and 52 and slide on the respective abutting surfaces 52*a* and 50*a*. That is, the first side surface 90'*c* of the dispensing slot 90' can move along with the first major surface 90'*a* thereof back and forth along the y-axis, and the second side surface 90'*d* of the dispensing slot 90' can move along with the second major surface 90'*b* thereof back and forth along the y-axis. In this manner, the width W' of the dispensing slot 90' that is at least partially overlapped with the width W of the opening 90 can be actively controlled by moving at least one of the first and second die lips 50 and 52 back and forth along the y-axis. FIG. 4 illustrates a moment at which the external opening 90 of the coating die body 22 is partially blocked by a portion 702 of the shim 70 and a portion 722 of the shim 72 such that the width W' of the dispensing slot 90' is smaller than the width W of the external opening 90. FIG. 5 illustrates a moment at which the dispensing slot 90' is fully open with the width W' of the dispensing slot 90' substantially the same as the width W of the external opening 90. It is to be understood that the thickness of the dispensing slot 90' and opening 90 along the z-axis may or may not be substantially the same, which can be controlled by varying the thickness of the shims 70 and 72.

In the depicted embodiments, the forming surfaces 90'*a-d* of the dispensing slot 90' are movable so as to dynamically adjust the width W' thereof. It is to be understood that in other embodiments, a portion of the forming surfaces may be fixed and another portion of the forming surfaces may be movable along the y-axis to dynamically adjust the width W'.

In some embodiments, when a substrate is provided adjacent the dispensing slot 90' and moves along the z-axis (i.e., a machine direction), coatings with various shapes can be applied onto the substrate by controlling and coordinating the dispensing slot width and the substrate motion.

Figure 6:
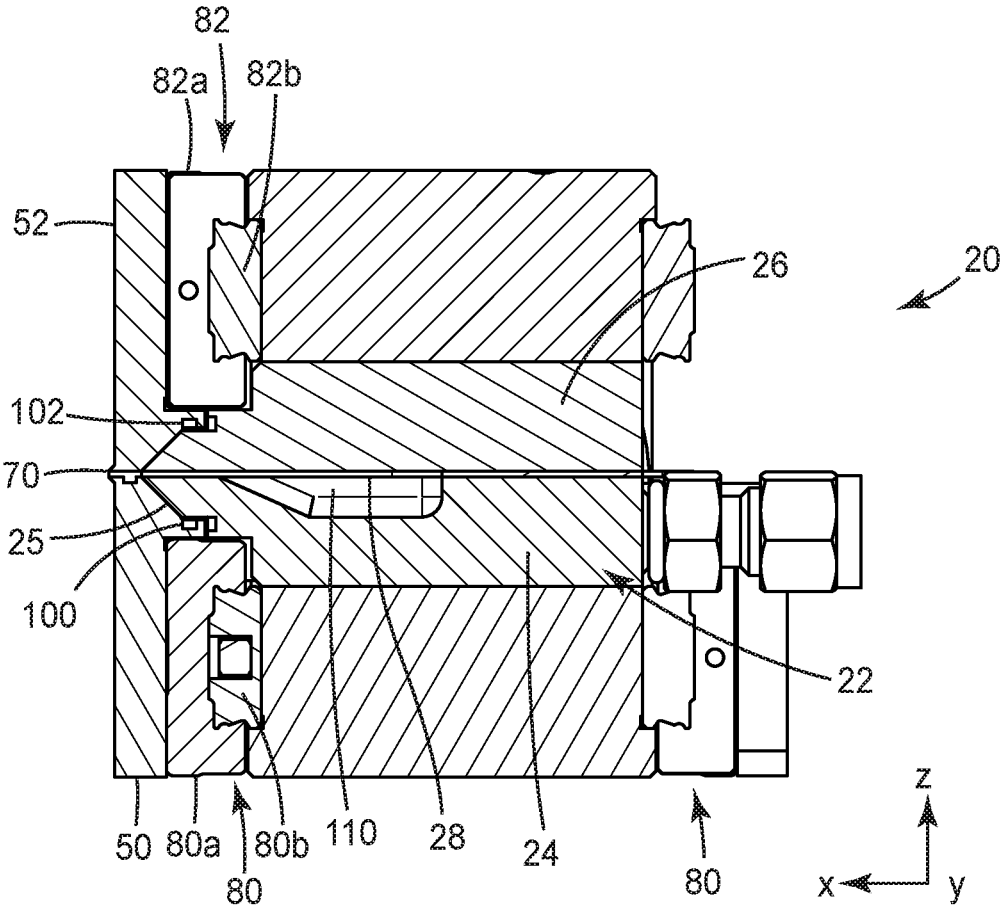
FIG. 6 is a cross-section side view taken along section lines 6-6 in FIG. 1.

Referring now to FIG. 6, a cross-section view taken along section lines 6-6 in FIG. 1 is illustrated. In this view it can be appreciated that the shim 70 of the movable die lip 50 does not extend into the cavity 110 of the coating die body 22. The die lips 50 and 52 butts up against the dispensing side 25 of the coating die body 22 and are movable thereon along the y-axis to dynamically control the coating width (e.g., the width W' of FIG. 4). The die lips 50 and 52 and the dispensing side 25 can have suitable matching surface shapes or configurations (e.g., mating projections and grooves, etc.) that allow the die lips 50 and 52 to slide on the dispensing side 25. Seals can be provided at locations 100 and 102 for sealing the first and second movable die lips 50 and 52 against the dispensing side 25 of the first and second die portions 24 and 26 respectively. The die lips 50 and 52 and the coating die body 22 can be made of suitable materials to increase their hardness and to reduce the friction at the sliding surfaces. In some embodiments, the die lips 50 and 52 and the coating die body 22 can be made of stainless steel. The seals and other contact pads disposed at the sliding surfaces can be made of materials having low coefficient of friction such as, for example, polytetrafluoroethylene (PTFE).

In some embodiments, the coating apparatus 20 may be operated at room temperature. In some embodiments, suitable heating or cooling mechanisms may be provided for the coating apparatus 20 to control temperatures. In some embodiments, one or more temperature sensors such as resistance temperature detectors (RTDs) can be provided for temperature measurement located at the movable die lips.

In the view of FIG. 6, it can be more readily appreciated that the linear rails 80 and 82 each can include one portion (e.g., 80*a* and 82*a*) fixed to the die body 22 and another portion (e.g., 80*b* and 82*b*) capable of smoothly moving the die lips 50 and 52 in the y-axis upon the force exerted by the first and second linear actuators 40 and 42 of FIG. 1. In some embodiments, more than one linear rails can be optionally provided for each of the die lips 50 and 52. In the depicted embodiment, a couple of linear rails 80 are provided for the die lip 50 to reduce deformation of the die lips during actuation and improve degree of stability.

Figure 7:
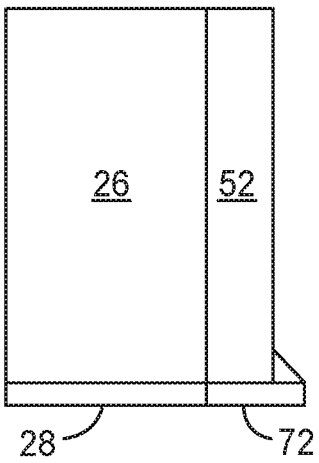
FIG. 7 is a schematic diagram of a movable die lip attached to a die body, according to one embodiment.
Figure 8:
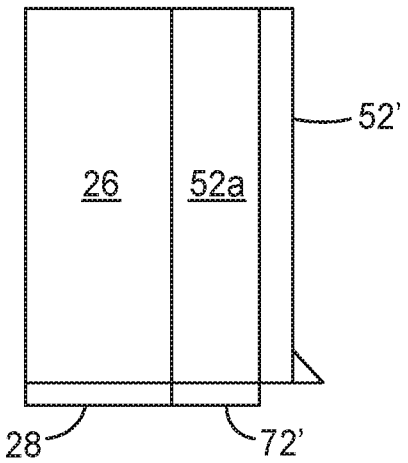
FIG. 8 is a schematic diagram of a movable structure sandwiched between a die body and a stationary die lip, according to one embodiment.

The coating apparatuses described herein provide one or more movable components disposed on the dispensing side of the die body to define at least a portion of a dispensing slot adjacent the opening of the cavity. The one or more movable components are movable with respect to the opening to allow a width of the dispensing slot along a cross direction to be dynamically adjustable. The movable components can be or include a die lip or other structures or components movably attached to a die body. In the embodiment shown in FIG. 7, the movable components include the die lip 52 that is movably attached to the die portion 26. The shim 72 is attached to the movable die lip 52 and approximately aligned with the stationary shim 28. The shim 72 is movable along with the die lip 52 to dynamically adjust the width of a dispensing slot formed thereof. In the embodiment shown in FIG. 8, the movable components include a movable segment 52*a* that is sandwiched between the die portion 26 and a stationary die lip 52'. A shim 72' is attached to the movable segment 52*a* and movable along with the movable segment 52*a*. The movement of the movable segment 52*a* and the shim 72' (e.g., in-and-out-of-the-paper) can dynamically adjust the width of the dispensing slot.

Figure 9:
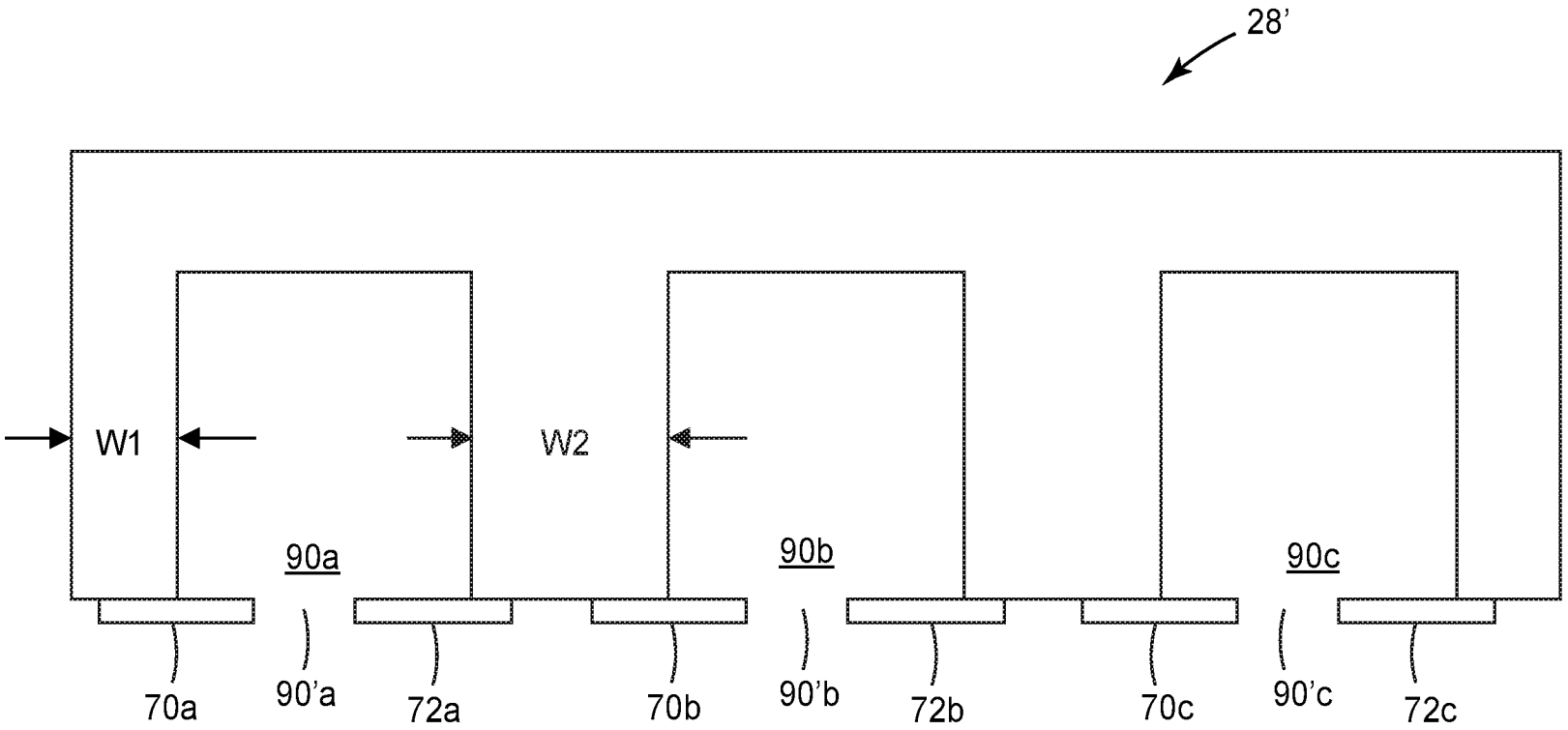
FIG. 9 is a schematic diagram of a coating apparatus including multiple dispensing slots, according to one embodiment.

In some embodiments, multiple coating apparatuses each including a single die body with a dispensing slot can be positioned to create multiple lanes or patches of coating at the same time. In some embodiments, multiple dispensing slots can be provided for a single die body. In the embodiment shown in FIG. 9, a stationary shim 28' defines multiple external openings 90*a*, 90*b* and 90*c* of one or more internal cavities such as the cavity 110 of FIG. 2. Shims 70*a*, 70*b* and 70*c* can be attached to a first movable component such as the first movable die lip 50 of FIG. 1, and shims 72*a*, 72*b* and 72*c* can be attached to a second movable component such as the second movable die lip 52 of FIG. 1. The shims 70*a-c* and 72*a-c*, and the movable components define multiple dispensing slots 90'*a-c*. In the depicted embodiment, the widths of the dispensing slots 90'*a-c* can be dynamically adjusted in the same way, and coatings from the dispensing slots can have the same shape. In other embodiments, the movable shims 70*a-c* and 72*a-c* can be independently controlled to create different patterns for each dispending slots. The widths W1 and W2 of the stationary shim 28' can be designed such that the seal between the movable shims (e.g., 70*a-c*, 72*a-c*) and the stationary shim 28' is intact for desired coating shapes and sizes.

The coating apparatuses described herein can further include a pump and a control system. The pump can be, for example, a high bandwidth precision pump that is in fluid communication with an input port (e.g., the manifold connection 112 of FIG. 2) of the coating die body 22. The pump is configured to supply the coating into the cavity of the coating die body at an adjustable flow rate. In some embodiments, the coating apparatus 20 can further include an accumulator in fluid communication with the input port. The control system can be functionally connected to the movable die lips, the accumulator, and the pump to actively controlling the width of a dispensing slot (e.g., the dispensing slot 90' of FIG. 4) such that coatings of actively controllable width and predetermined coating thickness can be dispensed out of the dispensing slot.

In some embodiments, a coating material can be supplied, via a pump, at a flow rate into the cavity 110 of the coating die body 22. At least one portion of the die lips 50 and 52 can be slidably moved, via the first and/or second linear actuators 40 and 42, back and forth along the y-axis to dynamically adjust the width of the dispensing slot 90'. The flow rate of the coating materials can be synchronously adjusted, via the control system, while changing the width of the dispensing slot. In some embodiments, changing the width of the dispensing slot may introduce pumping effects which can be compensated by adjusting the flow rate. The control system can also control the substrate motion (e.g., speed and directions) and coordinate it with the fluid flow and the slot width of a coating die to form various shaped coatings on the substrate.

The coating apparatuses and methods described herein can be used for precisely coating stripes or patches of liquid with various shapes or patterns on a substrate. In some embodiments, the coatings can have a non-rectangular shape such as, for example, a round shape, an oval shape, an irregular shape, a closed shape, or any combinations thereof. The various shaped articles can include one or more directly formed discrete patches and/or continuous stripes formed with minimum converting waste.

The present disclosure provides systems and methods for dynamically adjusting the width of a dispensing slot. The term "dynamically" means that the adjustment occurs at a high rate of speed, for example, at a rate fast enough to change the wide of the dispensing slot in real time, resulting in an article that varies in width as part of its intended function. For example, various shaped articles such as circular, oval, or triangular shaped articles can be created without post converting. The dynamical adjustment described herein is different from a simple static change in slot width that might be employed in a setup operation.

In some embodiments, the dynamical movement of one or more die lips or other movable components along the cross direction can be conducted at a range of frequencies. The term "frequency" described herein can be defined as the rate of the repetitive motion required to create the desired shape of articles. For example, to create a continuous stream of circular articles of 75 mm in diameter and a gap between circles of 25 mm, a complex repetitive motion can be conducted that repeats at a frequency based on the speed of the substrate passing by the dispensing slot. For example, at a substrate speed of 3 m/min, a repetitive rate of 0.5 Hz can be determined. When the substrate speed rises to 30 m/min, the repeat frequency may rise to 5 Hz.

The repeat frequency achievable may be dependent on many factors including, for example, the range of the width change, the speed of the line, the defined article geometry, etc. Even at slow repeat rates, extreme demands may be placed on the motion system for moving the movable structure so as to dynamically change the width of dispensing slot. The motion system, actuators and mechanics may employ high-precision mechatronic mechanisms to ensure very high bandwidth of motion and fidelity of the article to desired shapes. For example, a simple triangular shaped article, repeating at 0.5 Hz, may have infinite frequency components of the Fourier decomposition of the sampled time series of the repetitive pattern at the 0.5 Hz repeat rate. Inclusion of higher frequency terms can result in improved fidelity of the article to the geometric shape.

Figure 10A:
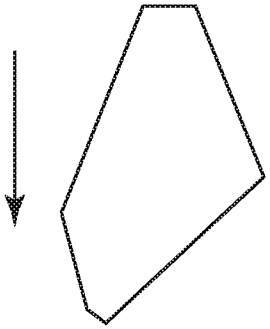
FIG. 10A illustrates a patch of liquid coating having an irregular shape.
Figure 10B:
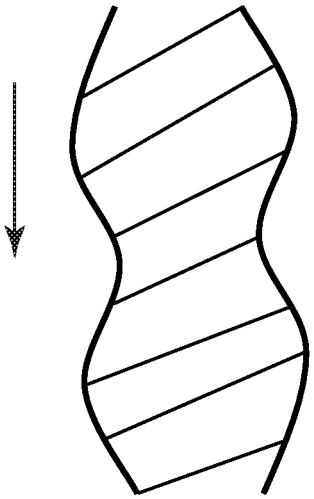
FIG. 10B illustrates a lane of liquid coating with an indefinite length having a varying width.

Some embodiments in the present disclosure can be used for creation of discrete articles (e.g., regular or irregular shaped patches), as well as continuous lanes of coated stripes (e.g., scalloped lanes or lanes with saw tooth edges). FIG. 10A illustrates an exemplary coated irregular shaped patch. FIG. 10B illustrates an exemplary continuous lane of coated stripe. The machine direction is indicated as the arrow.

Besides coating long-web-type substrates, some embodiments described herein may also be used on short substrate processing, as might be used in creating computer monitor, cell phone or tablet displays. This allows the direct creation of rounded rectangular or capsule shaped screen articles without using stencils, dams, or post processing and converting methods that presently dominate the manufacturing of discrete articles. In the present disclosure, by changing the substrate speed and direction, as well as precise coordination to the slot width, it is possible to create articles with extremely complex geometries.

Various unexpected results and advantages are obtained in exemplary embodiments of the disclosure. One such advantage of exemplary embodiments of the present disclosure is that the width of a dispensing slot can be dynamically adjusted such that liquid coatings with various shapes can be formed. In some cases, the dynamical width adjustment is achieved by rapidly (e.g., at a frequency no less than about 0.1 Hz) moving one or more die lips that define the dispensing slot back and forth along a cross direction. In some cases, the dynamical width adjustment can be conducted without adjusting the volume of the cavity, which is different from a conventional method of using a movable deckle inside a die body cavity.

Exemplary embodiments of the present disclosure may take on various modifications and alterations without departing from the spirit and scope of the disclosure. Accordingly, it is to be understood that the embodiments of the present disclosure are not to be limited to the following described exemplary embodiments, but are to be controlled by the limitations set forth in the claims and any equivalents thereof.

Listing of Exemplary Embodiments

It is to be understood that any one of embodiments 1-14 and 15-21 can be combined.

Embodiment 1 is an apparatus comprising:

a die body including a cavity, the cavity having an opening on a dispensing side thereof; and one or more movable components disposed on the dispensing side of the die body to define at least a portion of a dispensing slot adjacent the opening of the cavity, wherein the one or more movable components are movable with respect to the opening of the cavity to allow a width of the dispensing slot along a cross direction to be dynamically adjustable.

Embodiment 2 is the apparatus of embodiment 1, wherein the dispensing slot includes first and second major surfaces opposite each other, and first and second ends opposite each other, the distance between the first and second ends being the width of the dispensing slot along the cross direction.

Embodiment 3 is the apparatus of embodiment 2, wherein at least one of the first and second ends are movable along with at least one of the first and second major surfaces such that the width of the dispensing slot is dynamically adjustable.

Embodiment 4 is the apparatus of any one of embodiments 1-3, wherein at least one of the movable components includes a shim attached to an abutting surface thereof.

Embodiment 5 is the apparatus of embodiment 4, wherein the shim is movable along with the respective movable components back and forth along the cross direction to dynamically adjust the width of the dispensing slot.

Embodiment 6 is the apparatus of embodiments 4 or 5, wherein the movable components include a first movable component with a first shim and a second movable component with a second shim.

Embodiment 7 is the apparatus of embodiment 6, wherein the shim of a first movable component and the abutting surface of a second movable component form a first slidable sealing contact, and the shim of the second movable component and the abutting surface of the first movable component form a second slidable sealing contact.

Embodiment 8 is the apparatus of any one of embodiments 1-7, wherein the one or more movable components comprise one or more die lips.

Embodiment 9 is the apparatus of any one of embodiments 1-7, wherein the one or more movable components are disposed between the die body and a stationary die lip.

Embodiment 10 is the apparatus of any one of embodiments 1-9, further comprising one or more actuators functionally connected to the one or more movable components and configured to dynamically move the one or more movable components along the cross direction at a frequency in a range from about 0.1 Hz to about 500 Hz.

Embodiment 11 is the apparatus of any one of embodiments 1-10, wherein the cavity has a fixed volume which is not adjustable during dispensing liquid through the opening.

Embodiment 12 is the apparatus of any one of embodiments 1-11, further comprising a pump in fluid communication with an input port of the coating die body, the pump being configured to supply the coating into the cavity of the die body at an adjustable flow rate.

Embodiment 13 is the apparatus of embodiments 12, further comprising a control system functionally connected to the movable die lips and the pump to simultaneously control the width of the dispensing slot and the flow rate.

Embodiment 14 is the apparatus of any one of embodiments 1-13, wherein the dispensing slot has a fixed thickness substantially perpendicular to the cross direction.

Embodiment 15 is a method of dispensing a liquid using the apparatus of any one of the preceding embodiments, the method comprising:

supplying the liquid at a flow rate into the cavity of the die body; and moving at least one of the movable components along the cross direction to dynamically change the width of the dispensing slot.

Embodiment 16 is the method of embodiment 15, wherein moving at least one of the movable components comprises moving two of the movable components at the same time.

Embodiment 17 is the method of embodiment 15 or 16, further comprising adjusting the flow rate while changing the width of the dispensing slot.

Embodiment 18 is the method of any one of embodiments 15-17, further comprising dispensing the liquid onto a moving substrate to coat a patch of liquid thereon.

Embodiment 19 is the method of any one of embodiments 15-18, further comprising controlling the movement of the substrate according to the width of the dispensing slot.

Embodiment 20 is the method of embodiments 18 or 19, wherein the coated liquid has a substantially uniform thickness.

Embodiment 21 is the method of embodiments 18 or 19, wherein the coated liquid has a predetermined thickness profile that is not substantially uniform.

Reference throughout this specification to "one embodiment," "certain embodiments," "one or more embodiments" or "an embodiment," whether or not including the term "exemplary" preceding the term "embodiment," means that a particular feature, structure, material, or characteristic described in connection with the embodiment is included in at least one embodiment of the certain exemplary embodiments of the present disclosure. Thus, the appearances of the phrases such as "in one or more embodiments," "in certain embodiments," "in one embodiment" or "in an embodiment" in various places throughout this specification are not necessarily referring to the same embodiment of the certain exemplary embodiments of the present disclosure. Furthermore, the particular features, structures, materials, or characteristics may be combined in any suitable manner in one or more embodiments.

While the specification has described in detail certain exemplary embodiments, it will be appreciated that those skilled in the art, upon attaining an understanding of the foregoing, may readily conceive of alterations to, variations of, and equivalents to these embodiments. Accordingly, it should be understood that this disclosure is not to be unduly limited to the illustrative embodiments set forth hereinabove. In particular, as used herein, the recitation of numerical ranges by endpoints is intended to include all numbers subsumed within that range (e.g., 1 to 5 includes 1, 1.5, 2, 2.75, 3, 3.80, 4, and 5). In addition, all numbers used herein are assumed to be modified by the term "about."

Furthermore, all publications and patents referenced herein are incorporated by reference in their entirety to the same extent as if each individual publication or patent was specifically and individually indicated to be incorporated by reference. Various exemplary embodiments have been described. These and other embodiments are within the scope of the following claims.

What is claimed is:

1. An apparatus comprising:

a die body including a cavity, the cavity having an opening on a dispensing side thereof; and one or more movable components disposed on the dispensing side of the die body and outside of the opening of the cavity of the die body to define at least a portion of a dispensing slot adjacent to and substantially parallel to the opening of the cavity, wherein the one or more movable components are movable with respect to the opening of the die body to allow a width of the dispensing slot along a cross direction to be dynamically adjustable, wherein at least one of the one or more movable components includes an abutting surface to define the dispensing slot, and a shim is attached to the abutting surface and movable along with the at least one of the one or more movable components back and forth along the cross direction, the shim is positioned to be substantially parallel to the opening of the cavity of the die body such that when the shim moves, the shim at least partially blocks the opening of the cavity to dynamically adjust the width of the dispensing slot.

2. The apparatus of claim 1, wherein the dispensing slot includes first and second major surfaces opposite each other, and first and second ends opposite each other, the distance between the first and second ends being the width of the dispensing slot along the cross direction.

3. The apparatus of claim 2, wherein at least one of the first and second ends is movable along with at least one of the first and second major surfaces such that the width of the dispensing slot is dynamically adjustable.

4. The apparatus of claim 1, wherein the one or more movable components include a first movable component with a first shim and a first abutting surface, and a second movable component with a second shim and a second abutting surface.

5. The apparatus of claim 4, wherein the first shim of the first movable component and the second abutting surface of the second movable component form a first slidable sealing contact, and the second shim of the second movable component and the first abutting surface of the first movable component form a second slidable sealing contact.

6. The apparatus of claim 1, wherein the one or more movable components comprise one or more die lips.

7. The apparatus of claim 1, wherein the one or more movable components are disposed between the die body and a die lip thereof.

8. The apparatus of claim 1, further comprising one or more linear actuators functionally connected to the one or more movable components and configured to dynamically move the one or more movable components along the cross direction at a frequency in a range from about 0.1 Hz to about 500 Hz.

9. The apparatus of claim 1, wherein the cavity has a fixed volume which is not adjustable during dispensing liquid through the opening.

10. The apparatus of claim 1, further comprising a pump in fluid communication with an input port of the die body, the pump being configured to supply the coating into the cavity of the die body at an adjustable flow rate.

11. The apparatus of claim 10, further comprising a control system functionally connected to at least one of the one or more movable components and the pump to simultaneously control the width of the dispensing slot and the flow rate.

12. The apparatus of claim 1, wherein the dispensing slot has a fixed thickness substantially perpendicular to the cross direction.

13. A method of dispensing a liquid using the apparatus of claim 1, the method comprising:

supplying the liquid at a flow rate into the cavity of the die body; and moving at least one of the one or more movable components along the cross direction to dynamically change the width of the dispensing slot.

14. The method of claim 13, further comprising adjusting the flow rate of the liquid while dynamically changing the width of the dispensing slot.

15. The method of claim 13, further comprising adjusting the flow rate while changing the width of the dispensing slot.

16. The method of claim 13, further comprising dispensing the liquid onto a moving substrate to coat a patch of liquid thereon.

17. The method of claim 13, further comprising controlling the movement of the substrate according to the width of the dispensing slot.

18. The method of claim 16, wherein the coated liquid has a substantially uniform thickness.

* * * * *